US006845575B1

(12) United States Patent
Hwang

(10) Patent No.: US 6,845,575 B1
(45) Date of Patent: Jan. 25, 2005

(54) GOLF SHOES

(76) Inventor: Joon-Ho Hwang, 258-3, Galhyeon 2-dong, Unpyong-gu, Seoul, 122-802 (KR)

( * ) Notice: Subject to any disclaimer, the term of this patent is extended or adjusted under 35 U.S.C. 154(b) by 0 days.

(21) Appl. No.: 10/658,242

(22) Filed: Sep. 9, 2003

(30) Foreign Application Priority Data

Nov. 11, 2002 (KR) ..... 10-2002-0069802

(51) Int. Cl.[7] ..... A43B 5/00
(52) U.S. Cl. ..... 36/127; 36/144
(58) Field of Search ..... 36/127, 144, 143, 36/142

(56) References Cited

U.S. PATENT DOCUMENTS

| | | | | | |
|---|---|---|---|---|---|
| 4,149,324 | A | * | 4/1979 | Lesser et al. | 36/127 |
| 4,161,829 | A | * | 7/1979 | Wayser | 36/127 |
| 4,685,227 | A | * | 8/1987 | Simmons | 36/127 |
| 4,704,809 | A | * | 11/1987 | Ballard | 36/127 |
| 2004/0040181 | A1 | * | 3/2004 | Kim | 36/127 |

FOREIGN PATENT DOCUMENTS

| | | |
|---|---|---|
| KP | 1998-035048 | 9/1998 |
| KP | 1999-0026396 | 7/1999 |

* cited by examiner

*Primary Examiner*—Ted Kavanaugh
(74) *Attorney, Agent, or Firm*—Jordan and Hamburg LLP

(57) ABSTRACT

The present invention discloses golf shoes comprising outsoles including multiple jointing holes installing spikes respectively, uppers sewed or adhered with the outer circumstance of the top of the outsoles, and midsoles and insoles stacked sequentially to the outsoles within the uppers, wherein the protrusions 12 and 12' are protruded from the surroundings of the jointing holes 11 and 11' formed at the outsoles 10 and 10' of the golf shoes and protruded more and more form the inside to the outside direction to have a slope from the outside to the inside direction, the inside of the toe of the right outsole 10' is rounded to make rotation of the right golf shoe smooth at the finish step, and the outsole 10 of the left golf shoe, making a role of a prop at the finish step, is wider than the outsole 10' of the right golf shoe to widen the contact area with the ground in maximum.

2 Claims, 5 Drawing Sheets

GOLF SHOES

BACKGROUND OF THE INVENTION

1. Field of the Invention

The present invention relates to golf shoes preventing a golfer from excess movement of a body of the golfer into the left or the right outside direction (sway) usually generated in a golf swing such as a back swing, a down swing, an impact, and a finish, to keep the golf swing in an optimum trace to hit a golf ball not only more correctly but also to hit the golf ball further away, while playing golf.

2. Description of the Related Art

Briefly explaining a golf swing theoretically, the golf swing is achieved by six steps, a stance, an address, a back swing, a down swing, an impact, and a finish. A golfer puts his/her feet in appropriate positions from a golf ball at the stance step, puts his/her golf club to the back-side ground of the golf ball and poses appropriately to hit the golf ball at the address step, swings the golf club to the back of the golfer at the back swing step, swings the golf club to hit the golf ball at the down swing step, makes the head of the golf club hit the golf ball at the impact step, and makes the head of the golf club push the golf ball continuously according to the law of inertia and complete the golf swing finally at the finish step.

Usually, when the golf club is swung to the back of the golfer at the back swing step, body weight of the golfer is also tilted to the direction of the golf club movement (Body weight of a right-handed golfer is moved to the right outside direction and to the right leg of the golfer when the golfer swings his/her golf club). In this case, when the right leg does not support body weight of the golfer, it is hard to perform strong down swing utilizing body weight of the golfer to hit the golf ball further away. In more, because the body of the golfer is moved to the right outside direction against the address position, it is also hard to impact the golf ball correctly.

To minimize the inverse function by the right movement of the body, a golfer usually has endless training and drills for basic poses of the golf swing gathering both knees at the stance and the address step to make the right leg a role of an effective prop so that the body of the golfer is not moved to the right outside direction.

However, when the golfer gathers both knees to the inside direction of the body to make the right leg a role of an effective prop at the stance and the address step, a gap is generated between the outside of the right golf shoe and the ground. When the back swing is started at this state, the body weight is moved to the right outside direction excessively and easily because of the gap between the outside of the right golf shoe and the ground. Therefore, the golfer can not utilize the body weight to perform strong down swing to hit the golf ball further away. In more, because the body of the golfer is moved to the right outside direction against the address position, the possibility of correct impact to the golf ball is also reduced.

To hit the golf ball further away to the intended position at the impact step, the head of the golf club should hit the golf ball correctly as designated at the address position. However, when the body of the golfer is moved to the right outside direction at the back swing step, it is hard to impact the gold ball correctly according to the address position. Additionally, when the down swing is started to hit the golf ball, the weight of the golfer supported by his/her right leg mainly is moved again to the left leg of the golfer. In this case, when the left leg can not support the body of the golfer, it is hard to perform strong impact by utilizing the body weight of the golfer to hit the golf ball further away. In more, when the body of the golfer is moved to the left outside direction against the address state, the possibility of the correct impact to the golf ball is reduced.

To minimize the inverse function by the left movement of the body, the golfer usually has endless trainings and drills gathering both knees at the stance and the address step to make the left leg a role of an effective prop so that the body is not moved to the left outside direction.

However, both knees are gathered at the stance and the address step, a gap is generated between the outside of the left golf shoe and the ground. When the down swing is started at this state, the weight supported by the right leg mainly is moved to the left leg. Therefore, the body is moved to the left outside direction easily to lose the center of the body weight, it is hard to perform strong swing by the weight of the golfer and to hit the golf ball further away. In more, when the body is moved to the left outside direction against the address position, the possibility of the correct impact is reduced.

The finish step completing the golf swing keeps impact strength to the golf ball and makes the golf ball fly to the intended direction continuously. As the above statements, the weight supported mainly by the right leg at the back swing step is moved sequentially into the left leg through the down swing step, the impact step, and the finish step finally. In this case, when the left leg does not support the weight and the body is moved into the left outside direction excessively, it is hard to ensure strong impact strength to the golf ball and the continuous flight of the golf ball. Therefore, the flight distance of the golf ball is reduced and the flight direction is not correct.

When the golfer gathers both knees to the inside direction of the body to make his/her left leg a role of an effective prop, a gap is generated between the outside of the left golf shoe and the ground. When the down swing is performed at this state, the weight supported mainly by the right leg at the back swing step is moved into the left leg and the body is moved easily to the left outside direction because of the gap between the left golf shoe and the ground. Therefore, strong swing by the weight of the golfer is not performed. As a result, it is hard to hit the golf ball further away and to keep the flight direction of the golf ball in stable.

As the above statements, the golf swing moving the body into the left or the right direction excessively to lose impact strength and correctness to the golf ball is called by "sway". To prevent sway phenomena, it is the basic pose to gather both knees. However, the pose gathering both knees to prevent the sway makes a gap between the outsides of the golf shoes and the ground. Therefore, the body can be easily moved to the left or the right direction to generate sway without careful notices.

Prior arts to solve such problems are disclosed by Korean Utility Model Publication No. 98-35048 ("Golf shoes") and by Korean Patent Publication No. 99-26396 ("Golf shoes having a slope in outsole to the inside of the ball direction").

However, in the above described prior arts, the outside (1') of the outsole (1) of the golf shoes is thick and the inside (1") of the outsole of the golf shoes is thin. Therefore, the appearance of the golf shoes according to the prior arts is not smart and wearability of the golf shoes is remarkably low. In more, at the moment of body rotation centered by the toe of the right foot at the state of lifting up the heel of the right foot at the finish step completing the golf swing, smooth rotation of the right golf shoe is not achieved properly because the outsole (1) of the right golf shoe is flat and has the same slope with the outsole (1) of the left golf shoe.

In more, because the outsole (1) of the golf shoes according to the prior arts has the same size with the foot of the golfer without room, the left leg having a role of an effective prop at the finish step is moved into the left direction easily. Therefore, it is hard to perform strong swing by the weight of the golfer to hit the golf ball further away. In more, it is hart to keep the flight direction of the golf ball in stable.

Additionally, because the insole of the golf shoes according to the prior arts is a hard material that is difficult to support heels of the golfer, it is hard to absorb a shock generated at the impact step. In more, foot fatigue due to the weight of the golfer is generated and increased rapidly when the golfer walks long time.

SUMMARY OF THE INVENTION

To overcome the above described problems, preferred embodiments of the present invention provide golf shoes protruding protrusions of spikes of an outsole of the outside of the golf shoes more than that of the inside of the golf shoes, and having more slope at the outside than that of the inside of the golf shoes in the case of jointing the spikes with protrusions, to gather both knees to the inside of the body of a golfer naturally to have a stable pose.

In more, the present invention provides golf shoes with the rounded inside at the toe of the right outsole to be rotated smoothly, when the golfer rotates the toe of the right foot and lifts up the heel of the right foot at the finish step.

In more, the present invention provides golf shoes having the outsole of the left golf shoe, making a role of a prop at the finish step, wider than that of the right golf shoe to widen contact area of the left golf shoe to the ground in maximum to prevent the left leg from moving into the outside of the body, and to have a stable pose at the finish step, to hit the golf ball further away.

In more, the present invention provides golf shoes having an impact absorption hole of a predetermined size at the rear area of the hard insole to reduce foot fatigue in maximum by absorbing a shock at the impact step and a body weight of the golfer walking long time, and golf shoes having the inside insole thicker than the outside insole to make foot horizontal to reduce foot fatigue in maximum while the golfer walks.

To achieve the above described purposes, golf shoes of the present invention comprises outsoles including multiple jointing holes installing spikes respectively; uppers sewed or adhered with the outer circumstance of the top of the outsoles; and mid-soles and insoles stacked sequentially to the outsoles within the uppers, wherein: protrusions 12 and 12' are protruded from the surroundings of the jointing holes 11 and 11' formed at the outsoles 10 and 10' of the golf shoes, and protruded more and more from the inside to the outside direction to have a slope from the outside to the inside direction; the inside of the toe of the right outsole 10' is rounded to make rotation of the right golf shoe smooth at the finish step; and the outsole 10 of the left golf shoe, making a role of a prop at the finish step, is wider than the outsole 10' of the right golf shoe to widen the contact area with the ground in maximum.

In more, the present invention discloses golf shoes has the rear area of the hard insoles 30 and 30' of the golf shoes comprising the impact absorption holes 33 and 33' including the impact absorption plates 34 and 34' to absorb the weight of a golfer and a shock at the impact step; and the insoles 30 and 30' that is thicker more and more from the outside to the inside direction to make the foot horizontal with the ground when the golfer wears the golf shoes.

BRIEF DESCRIPTION OF THE DRAWINGS

For a more complete understanding of the present invention and the advantages thereof, reference is now made to the following descriptions taken in conjunction with the accompanying drawings, in which like reference numerals denote like parts, and in which.

DETAILED DESCRIPTION OF PREFFERED EMBODIMENTS

Reference will now be made in detail to preferred embodiments of the present invention, example of which is illustrated in the accompanying drawings.

Figure 1:
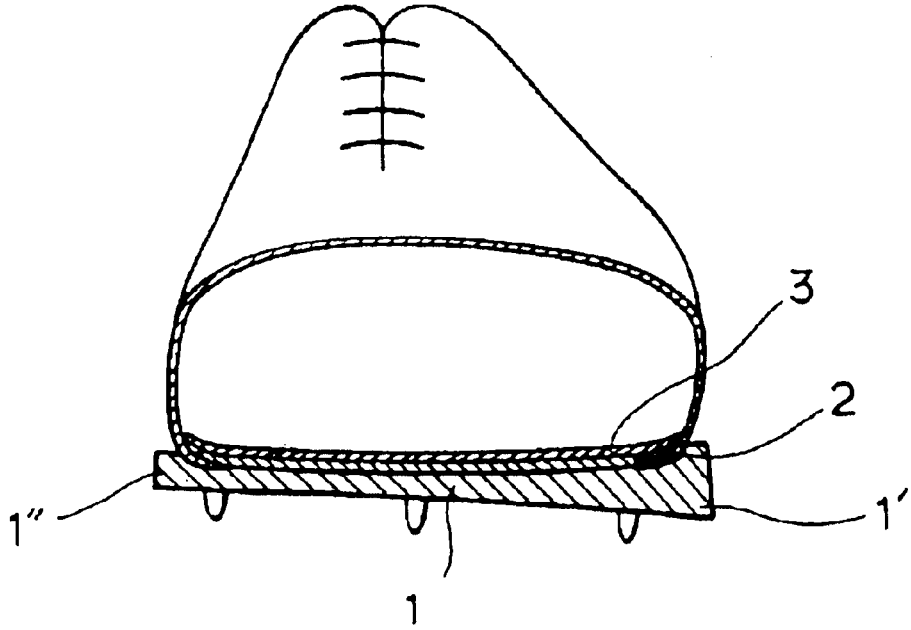
FIG. 1 is a cross-sectional view of the conventional golf shoes.
Figure 2:
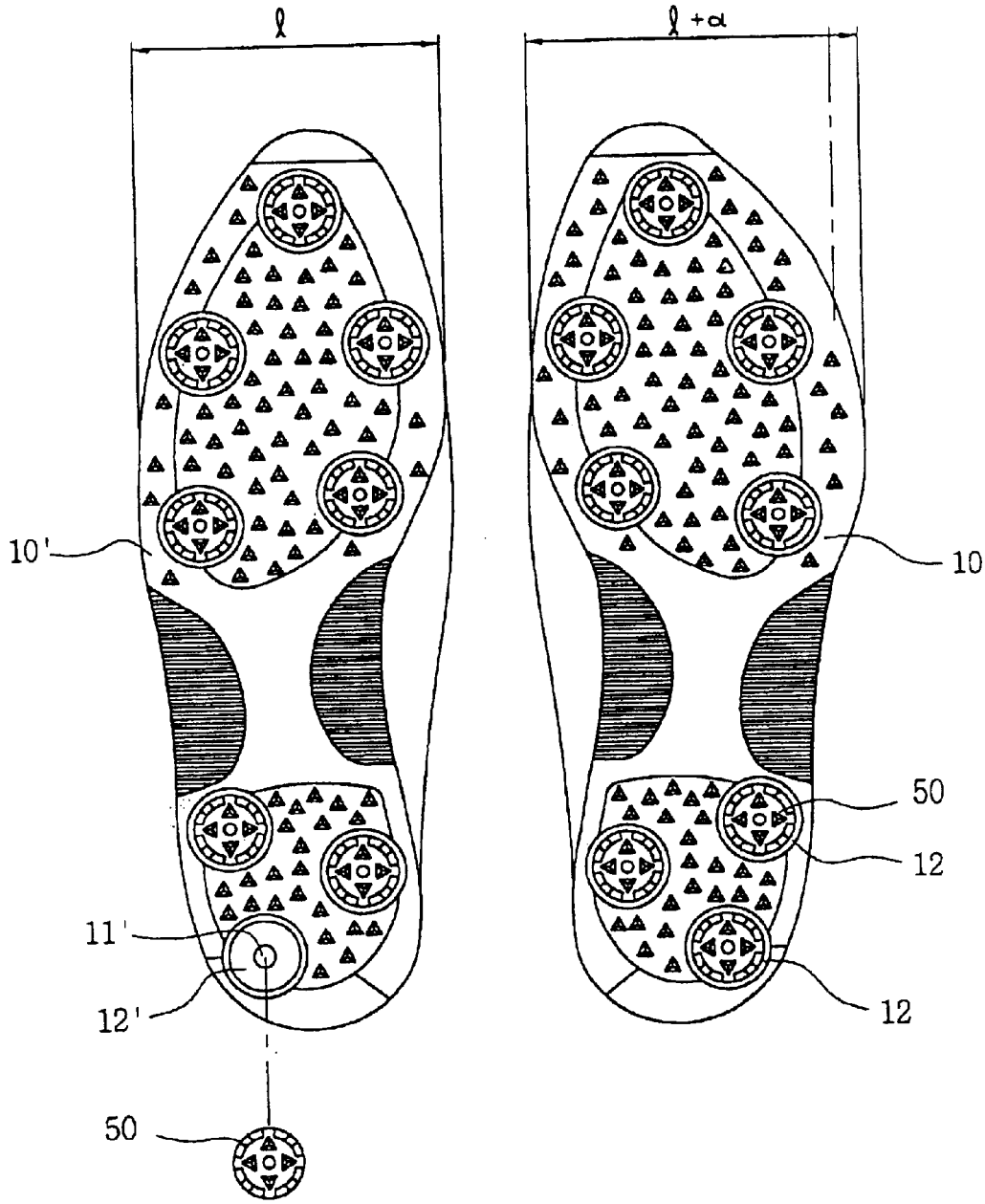
FIG. 2 is a plain view of golf shoes according to the preferred embodiment of the present invention.
Figure 3:
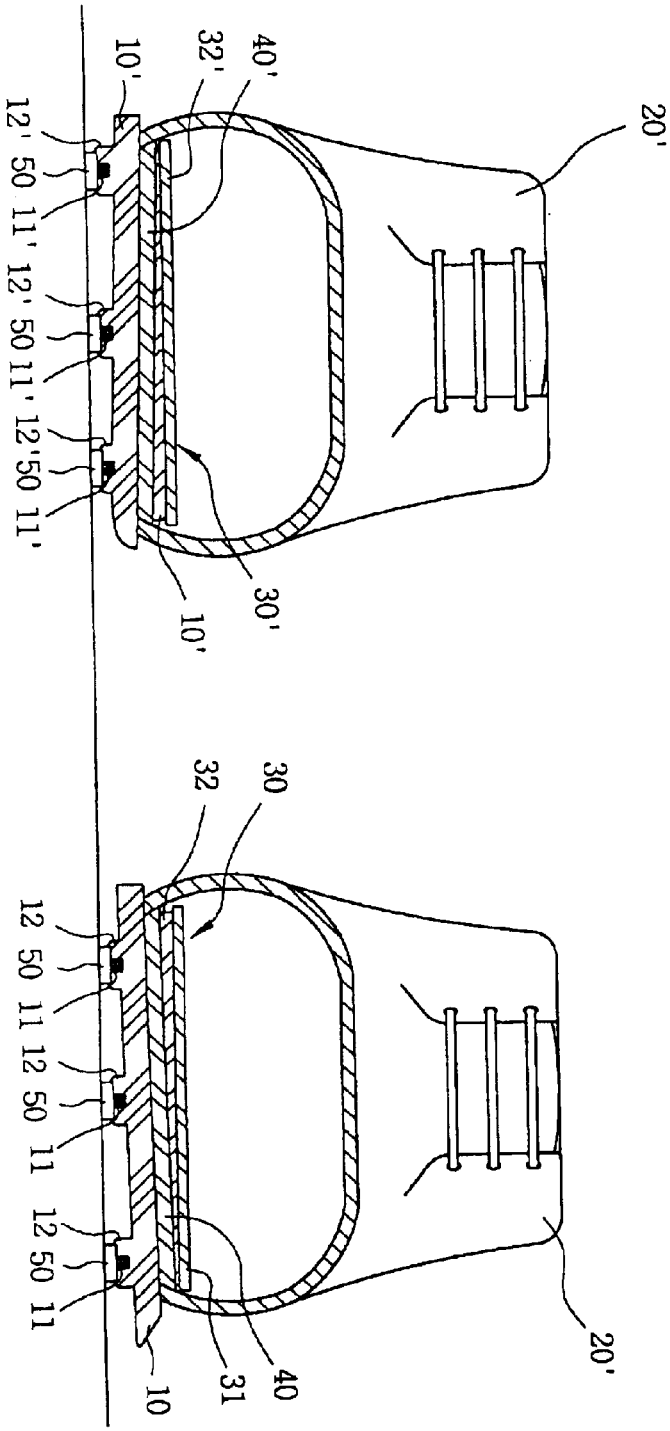
FIG. 3 is a cross-sectional view of FIG. 2.

FIG. 2 is a plain view of golf shoes according to the preferred embodiment of the present invention and FIG. 3 is a cross-sectional view of FIG. 2. The golf shoes of the present invention comprises outsoles 10 and 10' including multiple jointing holes 11 and 11' installing spikes 50 respectively, uppers 20 and 20' sewed or adhered to the outer circumference of the top of the outsoles 10 and 10', midsoles 40 and 40' and insoles 30 and 30' stacked sequentially in the outsoles 10 and 10' within the uppers 20 and 20'.

At first, in the surroundings of the jointing holes 11 and 11' at the outsoles 10 and 10' of the golf shoes, protrusions 12 and 12' are protruded. As shown in FIG. 3, the protrusions 12 and 12' of the outside are protruded more than that of the inside of the golf shoes. Therefore, when the golf shoes are worn at the state of jointing the spike 50 with the jointing holes 11 and 11', the golf shoes are tilted to the inside of the body to make a golfer gather his/her both knees naturally. In this case, an angle of about 3 to 6 degree is preferable as a slope between the outsoles 10 and 10' with the protrusions 12 and 12' and the ground. When the slope is less than 3 degree, not only the effect gathering both knees is insignificant but also the left leg does not effectively support body weight of the golfer at the finish step.

As shown in FIG. 2, the outsole 10 of the left golf shoe, having the width of "L+α", making a role of a prop at the finish step is wider than the outsole 10' of the right golf shoe, having the width of "L". Therefore, the maximized contact area between the left golf show and the ground prevent the left leg from distortion. In more, the toe of the inside of the right outsole 10 is rounded to make the rotation of the right golf shoe smooth at the finish step, while the side of the outsole 10 is perpendicular to the bottom of the outsole 10 at the toe of the right golf shoe.

Figure 4:
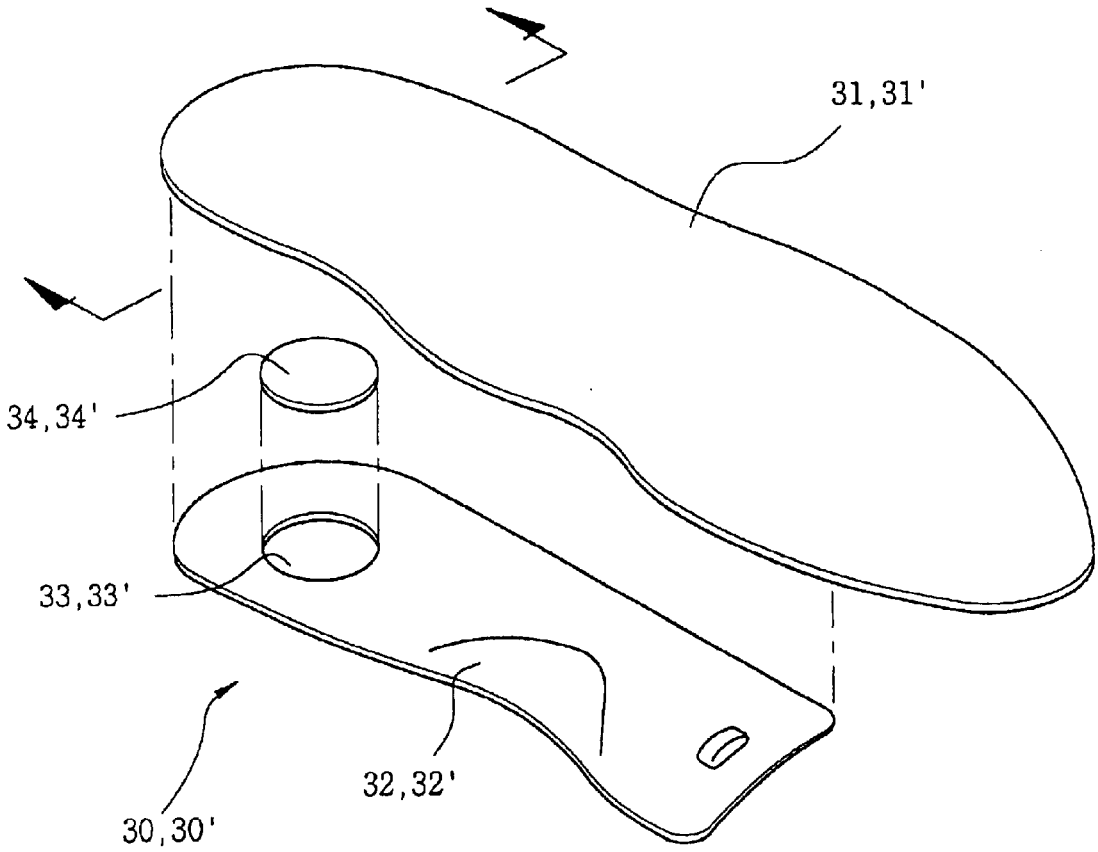
FIG. 4 is a disassembled perspective view of an insole of golf shoes according to the preferred embodiment of the present invention.
Figure 5:
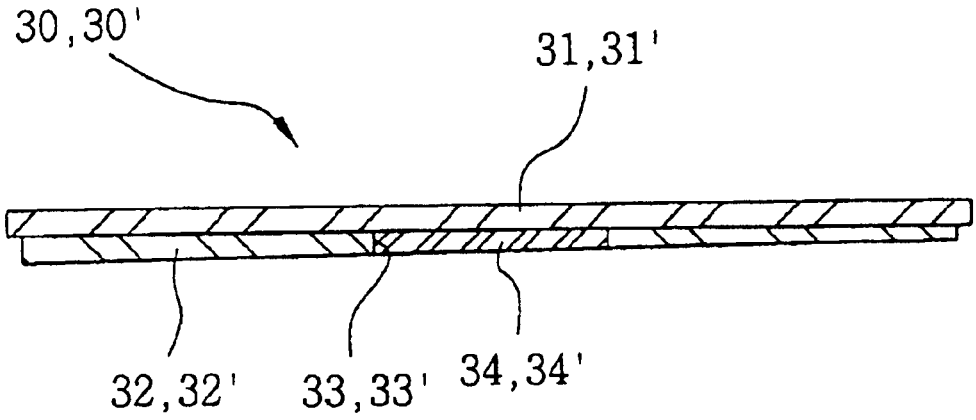
FIG. 5 is a cross-sectional view of FIG. 4.

On the contrary, as shown in FIG. 4 and FIG. 5, the insoles 30 and 30' of the golf shoes include hard plates 32 and 32' at the bottom of the soft foot-shaped cushions 31 and 31' to support the heel of the foot in stable. In this case, in the rear of the plates 32 and 32', impact absorption holes 33 and 33' of a predetermined size, for example about 20 mm, are formed to absorb an impact due to the weight of the golfer and at the impact step. Impact absorption plates 34 and 34' of a predetermined thickness may be inserted into the inside of the impact absorption holes 33 and 33', respectively.

In more, the outsides of the cushions 31 and 31' and plates 32 and 32' are thicker than the insides of the cushions 31 and 31' and plates 32 and 32' of the insoles 30 and 30'. Therefore, when the golfer wears the golf shoes, the foot of the golfer is horizontal with the ground. In other words, the insoles 30 and 30' are thick more and more from the outside to the inside direction, which is inversely proportional with the trend of the thickness of the protrusions 12 and 12'. Therefore, the golfer minimizes foot fatigue, while he/she walks.

The function of the golf shoes as described in the above statement is illustrated in the following. At first, the protrusions 12 and 12' of the outsoles 10 and 10' of the golf shoes are protruded more and more from the inside to the outside direction. Therefore, as shown in FIG. 3, the golfer can gather both knees to the inside direction of the body to perform a golf swing or putting more correctly.

As shown in FIG. 2, because the left outsole 10 is about "α" as wide as the right outsole 10', the contact area between the left golf shoe and the ground is widened in maximum, and the left leg supports the weight of the golfer firmly to ensure not only strong impact to the golf ball but also stable flight of the gold ball. Therefore, the flight distance is prolonged and the correct flight direction is ensured.

In more, the rounded inside of toe of the right outsole 10', makes rotation of the right golf shoe smooth, while the side of the right outsole is perpendicular to the bottom of the right outsole.

In more, the golf shoes comprises the impact absorption holes 33 and 33', while the rear area of the impact absorption holes 33 and 33' includes the impact absorption plates 34 and 34' respectively. Therefore, the weight of the golfer is absorbed to reduce foot fatigue during walks and strong shock transferred to the body at the impact step is absorbed smoothly.

In more, the insoles 30 and 30' is thick more and more from the outside to the inside direction, which is inversely proportional to the protrusions 12 and 12' protruding more and more from the inside to the outside direction. Therefore, foot fatigue is minimized.

Therefore, the present invention discloses the protrusions 12 and 12' of the spike 50, at the outsoles 10 and 10' of the golf shoes, protruding more and more from the inside to the outside direction, and having a slope from the outside to the inside of the golf shoes in the case of jointing the protrusions 12 and 12' with the spike 50, to gather both knees of the golfer naturally to make the pose of the golfer stable.

In more, the present invention discloses the rounded inside of the toe of the right outsole 10' rotating at the same time with lifting up the heel by the center of the toe of the right foot at the finish step to make the rotation of the right golf shoe smooth and to keep perfect pose at the finish step.

In more, the present invention discloses the outsole 10 of the left golf shoe, making a role of a prop at the finish step, wider than the outsole 10' of the right golf shoe, widening the contact area with the ground to prevent the left leg from moving into the outside of the body and having a stable swing to hit the golf ball further away.

In more, the present invention discloses the impact absorption holes 33 and 33' of a predetermined size, formed at the rear area of the hard insoles 30 and 30' of the golf shoes, absorbing not only a shock at the impact step but also the weight of the golfer transferred from long walks to reduce fatigue of the golfer in maximum, and the insoles 30 and 30', thicker more and more from the outside to the inside direction, making the foot horizontal with the ground to minimize foot fatigue during walks.

While the invention has been particularly shown and described with reference to preferred embodiments thereof, it will be understood by those skilled in the art that the foregoing and other changes in form and details may be made therein without departing from the spirit and scope of the invention.

What is claimed is:

1. Golf shoes comprising:

a right outsole and a left outsole including multiple jointing holes installing spikes respectively;

uppers sewed or adhered with the outer circumstance of the top of the outsoles; and mid-soles and insoles stacked sequentially to the outsoles within the uppers, wherein:

protrusions are protruded from the surroundings of the jointing holes formed at the outsoles of the golf shoes, and protruded more and more from the inside to the outside direction to have a slope from the outside to the inside direction;

the inside of the toe of the right outsole is rounded to make rotation of the right golf shoe smooth at the finish step; and the outsole of the left golf shoe is wider than the outsole of the right golf shoe to widen the contact area with the ground.

2. The golf shoes according to claim 1, each comprising a hard insole wherein:

a rear area of the hard insoles of the golf shoes includes an impact absorption holes including an impact absorption plates to absorb the weight of a golfer and a shock at the impact step; and the insoles are thicker more and more from the outside to the inside direction to make the foot horizontal with the ground when the golfer wears the golf shoes.

* * * * *